United States Patent [19]

Kelly

[11] 4,144,680

[45] Mar. 20, 1979

[54] FREE FORM BUILDING CONSTRUCTION

[76] Inventor: Thomas L. Kelly, 50 Randolph Ave., Waterbury, Conn. 06710

[21] Appl. No.: 821,238

[22] Filed: Aug. 2, 1977

[51] Int. Cl.[2] ..... E04B 1/32

[52] U.S. Cl. ..... 52/80; 52/82; 126/270

[58] Field of Search ..... 52/80, 81, 82, 86, 249, 52/383, 612; 403/398, 399, 395; 126/270

[56] References Cited

U.S. PATENT DOCUMENTS

| | | | |
|---|---|---|---|
| 35,630 | 6/1862 | Rumbold | 52/81 |
| 979,444 | 12/1910 | Armond | 52/249 |
| 2,016,882 | 10/1935 | Andes | 52/383 |
| 2,365,145 | 12/1944 | Neff | 52/80 |
| 2,690,185 | 9/1954 | Pomykala | 52/80 |
| 3,798,851 | 3/1974 | Vtahara | 52/86 |

FOREIGN PATENT DOCUMENTS

| | | | |
|---|---|---|---|
| 600430 | 4/1948 | United Kingdom | 403/398 |

*Primary Examiner*—Price C. Faw, Jr.

*Assistant Examiner*—H. E. Raduazo

*Attorney, Agent, or Firm*—Peck & Peck

[57] ABSTRACT

A structure of generally dome shape including a supporting framework formed of circumferentially spaced vertical members and laterally extending members on each side thereof and means for clamping said laterally extending members to a vertical member. The laterally extending members being spaced apart substantially the same distance as the diameter of the vertical member to which they are clamped. An inside shell formed in any suitable manner of concrete, mesh and reinforcing members and an outside shell spaced from said inside shell and formed generally similarly to the inside shell, the inside and outside shells being connected to and supported by the spaced laterally extending members and fixed thereto providing an airspace between the inside and outside shells. A modification of the structure provides a solar heating arrangement on a part of the dome shaped structure which has a generally southern exposure.

3 Claims, 7 Drawing Figures

FREE FORM BUILDING CONSTRUCTION

BRIEF SUMMARY OF THE INVENTION

A generally dome shaped structure formed of bent, vertically extending preferably tubular members to which are clamped laterally extending members which are disposed on opposite sides of the vertical members and extend therebetween throughout the circumference of the structure.

The invention involves a unique and novel clamping means for wedgedly securing the spaced apart laterally extending members to each side of the vertical members, an inside concrete shell is provided and supported by the inside laterally extending member while an outside shell of concrete is supported by the outside laterally extending member so that the inside and outside shells are spaced apart due to the spacing of the laterally extending members to thereby provide an insulating airspace between these shells.

The invention also provides solar heating means for that part of the structure which is directed towards the south so that this part receives solar rays, the remaining part of the structure is preferably formed as briefly discussed above, with the two spaced apart concrete shells. The solar heating circumferential part of the structure is so formed that solar heating zones are provided covering the solar heating part of the structure.

Additional objects and advantages of the present invention will become more readily apparent to those skilled in this art when the following general statements and descriptions are read in the light of the appended drawings.

DETAILED DESCRIPTION

The construction technique which is followed, as will become apparent, provides a free form construction which uses continuous lengths of pipe or other equivalent supporting members as the basic structural framework. The continuous lengths of pipe are generally vertically extending and are bent into the desirable angularity providing a dome-like structure, and the basic pipe lengths are interlocked, clamped or wedged with other pipe lengths so as to produce a generally dome or geodesic shaped structure, but it is to be distinctly understood that the utilization of these bent continuous lengths of pipe are capable of various configurations or angularities so that the structure is not restricted to the dome shape which is illustrated and will be described herein.

Figure 1:
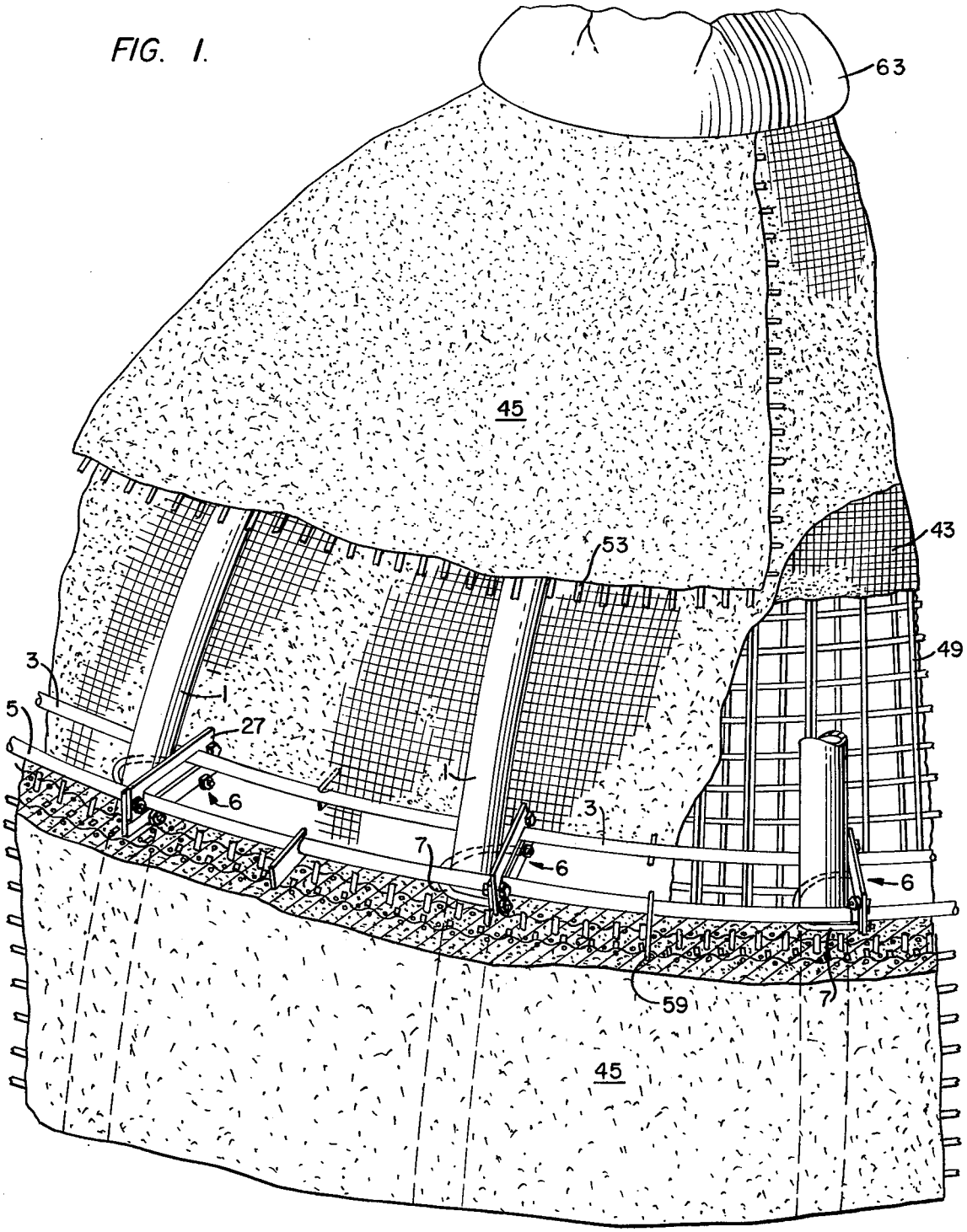
FIG. 1 is a view in perspective of a free form building construction with parts thereof broken away.
Figure 2:
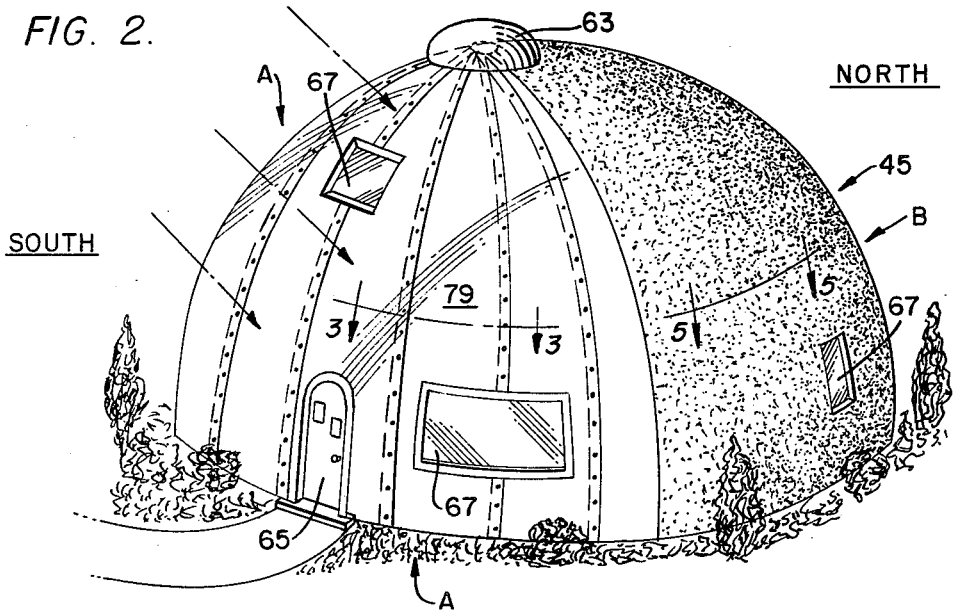
FIG. 2 is a view of a modified form of free form building construction involving a solar heating system in a portion thereof.
Figure 3:
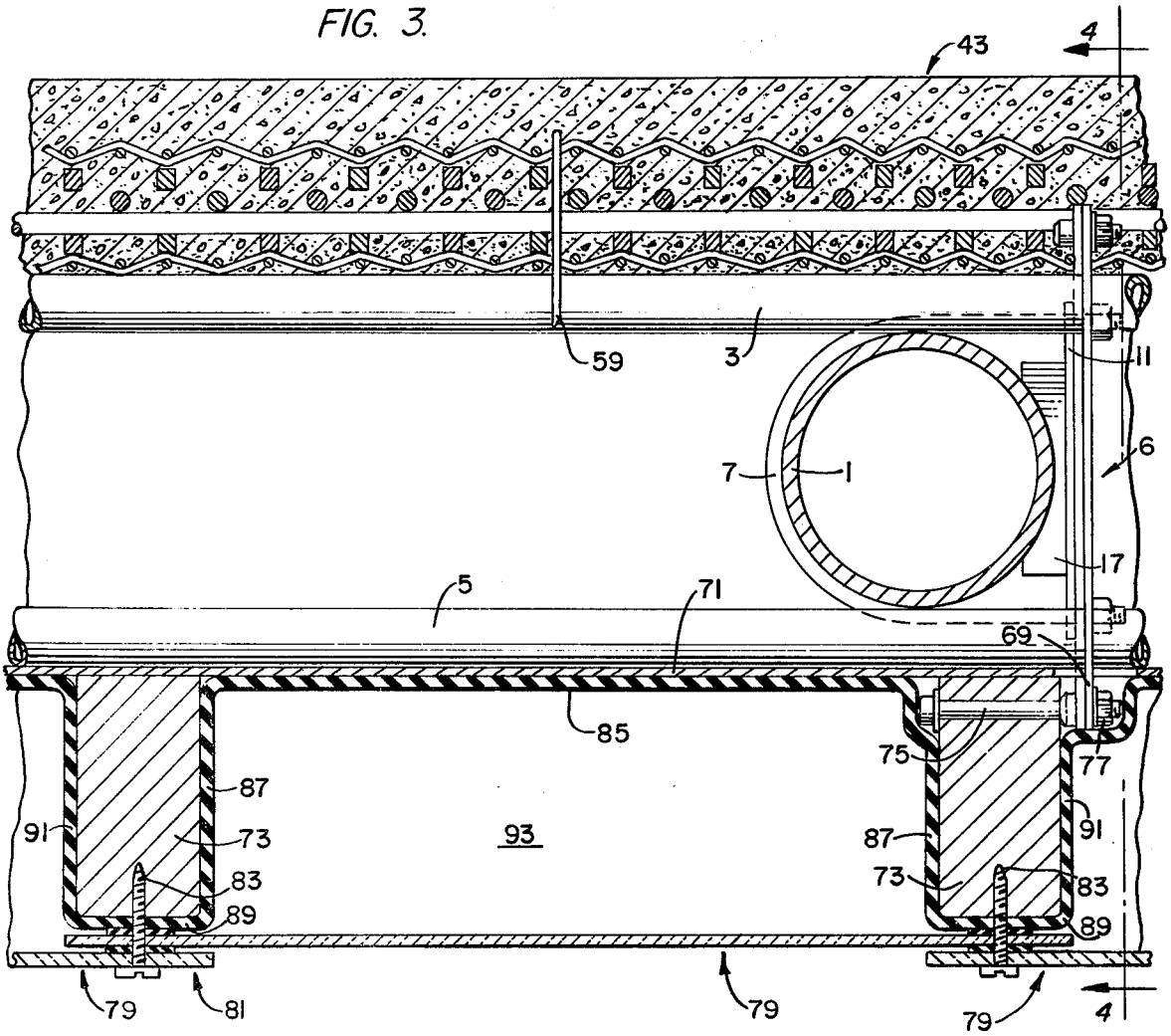
FIG. 3 is a view taken on the line 3—3 of FIG. 2.
Figure 4:
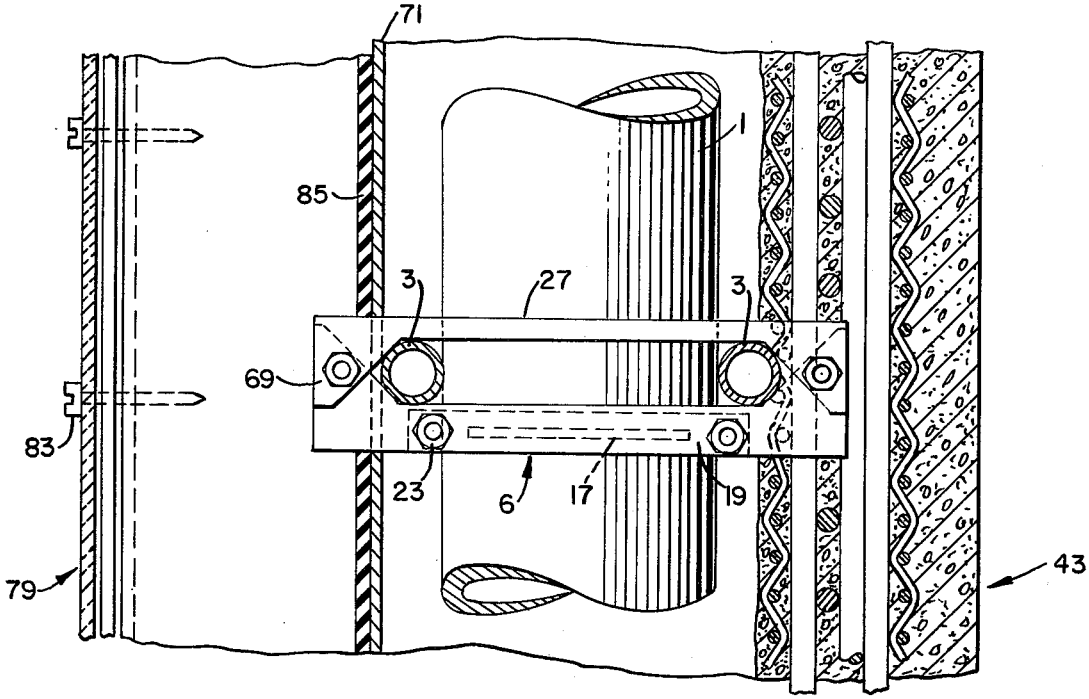
FIG. 4 is a view taken on the line 4—4 of FIG. 3.

In FIG. 1 of the drawings a building construction of this invention is disclosed and the structure consists of a plurality of circumferentially spaced preferably, though not necessarily, tubular members 1 which extend generally vertically from the supporting medium for the structure and are bent to provide the desired configuration for the building construction. The building structure also involves a plurality of laterally extending, preferably though not necessarily, tubular members 3 and 5 which, as will be explained, are interlocked and clamped to the generally vertically extending supporting members 1. Each pair of laterally extending members 3 and 5 are vertically spaced apart along the members 1 and any number or desirable spacing may be used. In order to make this description of the construction crystal clear the laterally extending members 3 will be termed the inside members and the laterally extending members 5 will be termed the outside members, and it is to be appreciated that the laterally extending members 3 and 5 are clamped, by means to be specifically described, to each of the circumferentially spaced members 1 and that the laterally extending member 3 is positioned on the inner side of each vertically extending member 1 while the laterally extending member 5 is positioned on the outer side of each vertically extending member 1.

Figure 7:
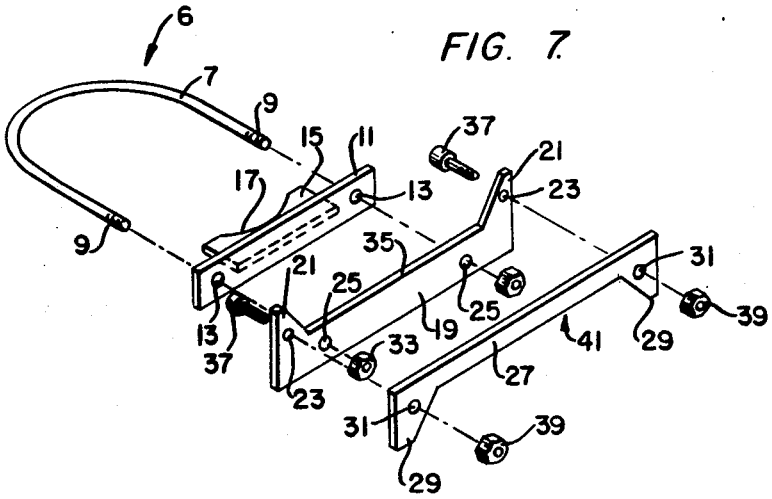
FIG. 7 is an exploded view in perspective of the mechanism for clamping the laterally extending spaced supporting members to the vertically extending supporting members.

In FIG. 7 of the drawings the means for clamping the laterally extending members 3 and 5 to the vertically extending members 1 is particularly disclosed. This clamping means which I have designated generally by the numeral 6 comprises a generally half loop element 7 having on each end or leg thereof a threaded portion 9. A transversely extending or half loop anchor bar 11 is provided having an aperture 13 formed therein adjacent to but removed from each of the outer edges of the bar. Extending from one side of the bar 11 is a flange or gusset 15 having an arcuate surface 17 formed therein. The curvature of surface 17 is such that it conforms to the curvature of the vertical member 1 which, when the clamping means is in operative position will be received therein. What I shall term a base bar 19 is provided with upstanding ears 21 at each end thereof. An aperture 23 is provided through each ear 21 and the base bar 19 is also provided with a pair of spaced apart apertures 25. An upper locking bar 27 is provided having at the ends thereof downwardly extending ears 29 each of which is apertured as at 31. In use as a clamping mechanism securely wedging and affixing the members 3 and 5 to the vertically extending members the half loop 7 is positioned partially about a vertical member 1 and on the other side of the vertical member 1 the member 11 is positioned so that a part of the vertical member 1 will be received in the curved recess 17, whereupon the legs of the half loop 7 are inserted through the apertures 13 and also through the apertures 25 and are fixed in this position by means of nuts 33 which are threaded on the legs 9 on the half loop 7 to thereby clamp the half loop 7 about the vertical member 1 and the degree of clamping or wedging action will be determined by the tightness with which the nuts 33 are screwed on to the threaded legs 9. With this accomplished it will be appreciated that the bars 11 and 19 are likewise firmly connected to the vertical member 1 through the half loop 7. The laterally extending members 3 and 5 are bedded or received in the base bar 19, one such laterally extending member being positioned on one side of the base bar 19 and the other being positioned on the other side of the base bar 19 and each of these laterally extending bars rest against an ear 21 and the floor 35 of the base bar 19. Whereupon the upper locking bar 27 is positioned relative to the base bar 19 by means of bolts 37 which are passed through the apertures 23 in the base bar 19 and through the apertures 31 in upper locking bar 27, the two bars 19 and 27 being removably fixed together by means of nuts 39 which are threaded onto the ends of the bolts 37 which extend through the apertures 31 in upper locking bar 27. With the laterally extending members 3 and 5 bedded on base bar 19 as described the rods 3 and 5 will be received at opposite sides of the upper bar 27 at the points wherein the angular portion of the downwardly extending ears of 29 merge with the upper transverse surface 31 of the bar 27.

It will now be recognized that due to this particularly ingenious arrangement for clamping the laterally extending members 3 and 5 to the generally vertically extending members 1, the members 3 and 5 will be spaced apart a distance substantially equal to the diameter of each vertically extending rod 1. As will become evident as this description proceeds this spacing of the inner and outer laterally extending members provides supporting means for an inner shell and an outer shell of the structure, the inner and outer shells providing between them dead air spaces.

Figure 5:
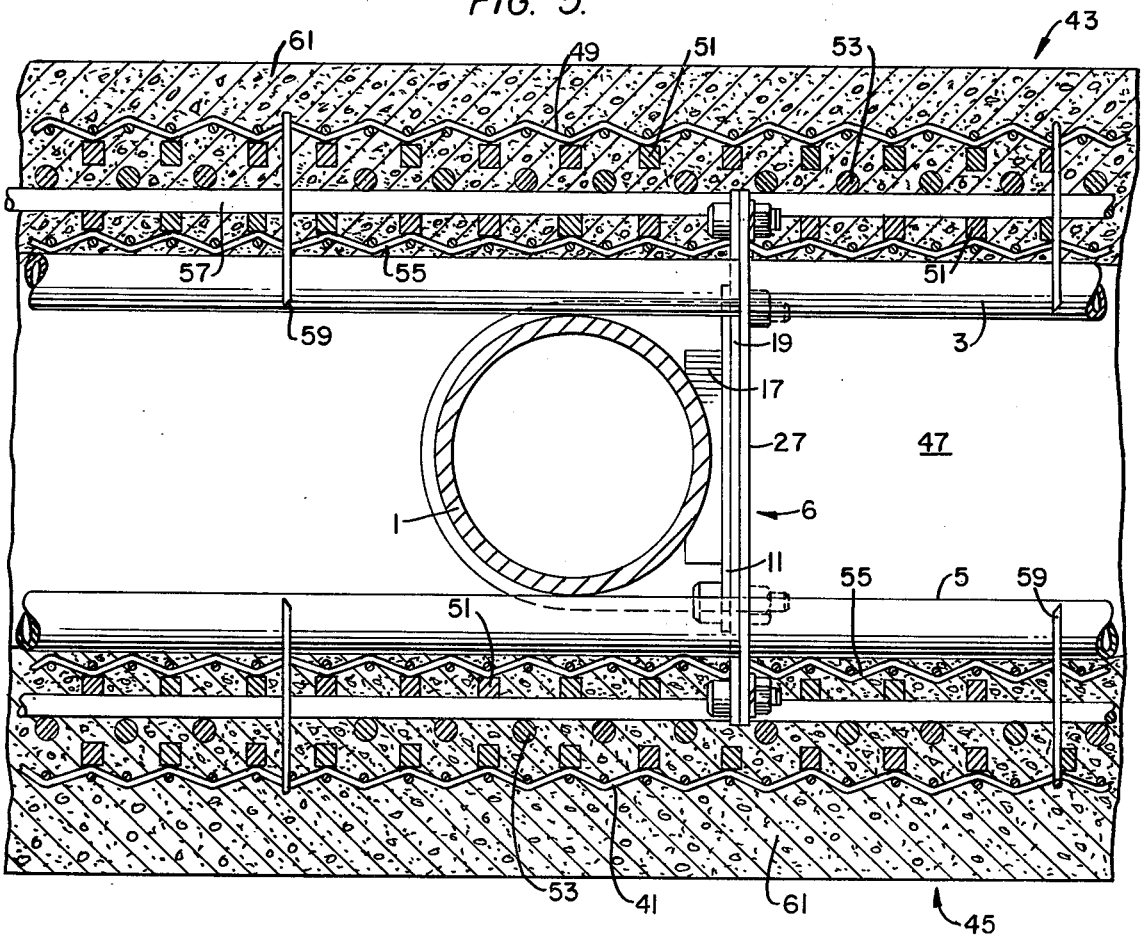
FIG. 5 is a view taken on the line 5—5 of FIG. 2.
Figure 6:
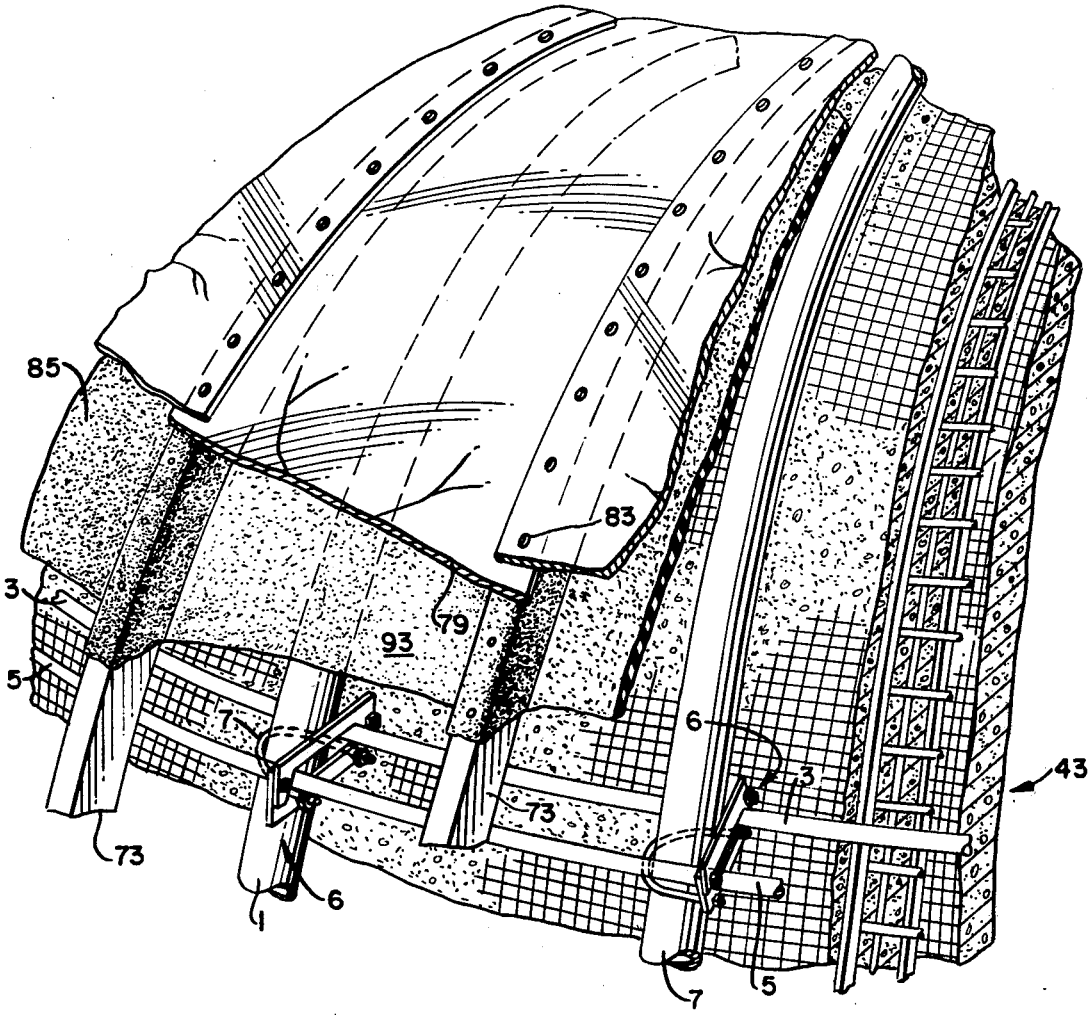
FIG. 6 is a view with parts thereof broken away showing the solar heating portion as illustrated in FIG. 2.

Consideration of FIG. 5 of the drawings shows the inner laterally extending member 3 and the outer laterally extending member 5 in proper inner and outer shell supporting positions and these members are clamped to a vertically extending member 1 of the free form building construction. The inside wall or shell of the structure has been designated in its entirety by the numeral 43 while the outside wall or shell of the structure has been designated in its entirety by the numeral 45, and as will be explicitly explained and made clear hereinafter the inner laterally extending member 3 supports the inside wall or shell 43 and the outer laterally extending member 5 supports the outer wall or shell 45, and since the members 3 and 5 are spaced apart the walls or shells 43 and 45 will be spaced apart providing a dead air space 47 between the inner and outer walls or shells.

The inside and outside walls 43 and 45 are preferably though not necessarily of the same construction and each comprises a concrete reinforcing mat comprising a sandwich of wire mesh 49 and any suitable and well known types of reinforcing elements 51 and 53 and a further wire mesh 55 and preferably though not necessarily tie rods 57. Any suitable number of clips 59 are fixed to the mesh layers 49 and 55 and to the laterally extending members 3 and 5. If desired the clips, which are well known in this discipline, may only be attached to one of the wire mesh layers. Into this structure of the mesh layers and reinforcing rods farrel cement 61 is applied and properly cured to form a shell for the building structure. It is to be distinctly understood that variations in the particular form which these shell or wall structures may take maybe utilized and still fall within the spirit and scope of this invetion.

At the top of the structure as particularly illustrated in FIG. 1 a dome may be provided and this may consist of means collecting heat generated between the inside shell and the outside shell or it may function as a skylight, or the like for the structure.

In FIGS. 2, 3, 4 and 6 a modified form of this free form building construction is disclosed and in this modified form of the invention I have provided a unique arrangement whereby that side of the structure which faces generally the south or the direction from which solar rays are generated is formed to collect the heat generated by such rays for the heating of the structure. In the description of FIGS. 2, 3, 4 and 6 the same reference numerals will be used for similar parts which were used in the description of FIGS. 1, 5 and 7. It will be evident that with the energy shortage which is now upon us that solar heating of structures such as this is of substantial significance. Consideration, particularly of FIG. 2 of the drawings, will indicate that I contemplate in this modified proposal, providing the south portion A of the structure with means, which will be described in detail, for collecting the solar rays for the heating of the structure, while the remaining portion B of the structure is formed as shown in FIGS. 1, 5 and 7 and described in detail hereinabove.

One or more doors 65 and windows 67 may be formed in the structure, and in this connection it is to be understood that such doors and windows or other type openings may be provided in the form of the invention disclosed in FIG. 1. Such doors and windows may be formed by bending tubular members such as the members 1 or 3 and 5 into a configuration to properly produce such openings in the structure, and the manner of doing this will be readily apparent to one skilled in the art. These dome structures may, of course, be provided with multifloor levels, center openings for light along with the windows and doors, in any place therein which may be deemed necessary and is accomplished merely by hooping off the main framework.

In the southern portion A of the structure which receives direct sunlight an inside wall or shell is formed which may be the same as the inside wall 43 illustrated in FIG. 5 of the drawings and therefor need not be described in detail at this time. It is within my contemplation to dispense with the type of inside wall 43 for this solar heating construction and to substitute therefor merely a relatively thin skin or covering for the inner laterally extending members 3. Such covering being adapted to receive, if desired, any suitable decorative medium for the inside of the structure.

The outside wall of the solar heating portion A of the structure is so formed, as will be described in detail, to provide a plurality of solar heating zones which follow substantially the configuration of the vertical members 1. The clamping assembly 6 which is used in the solar heating portion A operates generally similarly to the clamping assembly 6 described in connection with FIG. 1, however, the base supporting member 19 and the support bar 27, in this form of the invention, are somewhat lengthened as at 69 for a purpose to be described. An elongated piece of any suitable material 71 extends between the outer members 5 and is affixed thereto in any suitable manner. A plurality of circumferentially spaced blocks or risers 73 are provided which extend outwardly from and are fixed to the material 71 and function to support various components which form the solar heating zones. Each riser 73 is preferably formed of wood or any suitable or similar material into which screws may be threaded. All of these risers 73 which are adjacent to a vertically extending member 1 are firmly fastened into the assembly by means of a rod 75 which extends through a block adjacent to but spaced from the inner end thereof and at one end each such rod 75 extends therebeyond and is received and locked by means of a bolt 77 to the extending ends of certain components of the clamping assembly which were mentioned above. The riser blocks 73 which are not adjacent to a vertical member 1 do not need to be fastened into a clamping assembly 6 and are preferably affixed by adhesive means or the like to the material 71.

The exterior of the solar heating portion A of the structure is provided with a skin which is composed of a plurality of panes of one way glass designated generally by the numeral 79, and each pane of glass extends between adjacent risers 73 and the ends of adjacent panes of glass overlap at the heads of the blocks 73 as at 81. The adjacent overlapping panes of glass are firmly secured to each riser by means of a screw 83. I provide sheets or a continuous sheet of reflectant metal or an absorbing rubber membrane 85 which, as will be apparent from consideration of the drawings, extends over and is affixed to the material 71 and along the inner side of each riser block 73 as at 87 and across the top of such blocks as at 89 and inwardly along the other side of the block as at 91. The portions of the absorbing or reflecting membrane which extend over the blocks may be glued thereto and it will be clear that each screw 83 passes through such membrane where it passes over the outer side of the block. It will now be evident that this construction provides a solar heating chamber 93 which collects the heat generated by the solar rays reflected by the panes of glass 79 and absorbed by the medium 85 and such generated heat will flow upwardly through these generally upwardly extending solar heating chambers to a heat dome or the like 63.

What is claimed is:

1. A building structure, including in combination, a basic framework comprising a plurality of generally vertically extending spaced apart members, said members assuming any desired configuration to provide a building structure of the desired form, a plurality of pairs of laterally extending members, said pairs of laterally extending members being vertically spaced apart along said generally vertically extending members and said pairs of laterally extending members extending between adjacent vertically extending members, said pairs of laterally extending members extending about said building structure, means clamping each of said pairs of laterally extending members to each of said generally vertically extending members and one of said laterally extending members of a pair being clamped to said generally vertically extending members on one side thereof and the other of said pair of laterally extending members being clamped to said generally vertically extending members on the other side thereof, the said clamping means includes a half loop extending about a generally vertically extending member and includes mechanism including a half loop anchor bar, a base bar and said half loop being fastened to said half loop anchor bar and said base bar, an upper locking bar fastened to said base bar and positioned thereabove, a recess being provided by said base and upper locking bars and said laterally extending members being bedded and fastened in said recess.

2. A building structure including in combination, a basic framework comprising a plurality of generally vertically extending spaced apart members, said members assuming any desired configuration to provide a building structure of the desired form, a plurality of pairs of laterally extending members extending about said building structure and one of said laterally extending members of each pair being in contact with a vertically extending member on one side thereof and the other of said laterally extending members of the pair being in contact with said vertically extending member on the other side thereof, means clamping each laterally extending member of each pair to the vertically extending member with which each laterally extending member is in contact, the laterally extending members of a pair being spaced apart a distance substantially equal to the diameter of the vertically extending members, and one of said laterally extending members adapted to support an inner shell for said building structure and the other of said laterally extending members adapted to support the outer shall of said structure, and said clamping means comprises mechanism including a half loop anchor bar, a base bar, a half loop fastened to said half loop anchor bar and said base bar, an upper locking bar fasteneed to said base bar and positioned thereabove, a recess provided in said base and upper locking bars and said laterally extending members being bedded and fastened in said recess, said half loop anchor bar includes a flange conformed to the curvature of the generally vertically extending member and said flange is in engagement with said generally vertically extending member.

3. A building structure in accordance with claim 2, wherein said flange engages the generally vertically extending member on one side thereof and the half loop engages said vertically extending member on the other side thereof.

* * * * *